US005593056A

United States Patent [19]

Mero et al.

[11] Patent Number: 5,593,056

[45] Date of Patent: Jan. 14, 1997

[54] RIB FOR PLASTIC CONTAINER

[75] Inventors: Christopher J. Mero, New Millford; Richard F. Bellas, Stamford, both of Conn.

[73] Assignee: PepsiCo., Inc., Purchase, N.Y.

[21] Appl. No.: 436,652

[22] Filed: May 8, 1995

[51] Int. Cl.[6] ..... B65D 1/02; B65D 1/42; B65D 23/00

[52] U.S. Cl. ..... 215/382; 215/379; 220/669; 220/675

[58] Field of Search ..... 215/379, 382; 220/669, 671, 675

[56] References Cited

U.S. PATENT DOCUMENTS

| | | | |
|---|---|---|---|
| D. 358,547 | 5/1995 | Darr | D9/520 |
| 2,685,316 | 8/1954 | Krasno | 220/671 X |
| 2,723,779 | 11/1955 | Parker et al. | 215/382 X |
| 3,317,110 | 5/1967 | Palmer | 220/671 X |
| 3,871,541 | 3/1975 | Adomaitis . | |
| 4,890,757 | 1/1990 | Robbins, III | 215/382 X |
| 4,997,692 | 3/1991 | Yoshino | 215/382 X |
| 5,040,698 | 8/1991 | Ramsey et al. | 220/671 |
| 5,067,622 | 11/1991 | Garver et al. | 215/382 X |
| 5,199,587 | 4/1993 | Ota et al. | 215/382 X |
| 5,217,128 | 6/1993 | Stenger | 215/382 X |
| 5,279,442 | 1/1994 | Jentzsch et al. | 220/671 |
| 5,381,910 | 1/1995 | Sugiura et al. | 220/669 X |

FOREIGN PATENT DOCUMENTS

| | | | |
|---|---|---|---|
| 662438 | 4/1963 | Canada | 220/675 |
| 0425124 | 5/1991 | European Pat. Off. . | |
| 0502391 | 9/1992 | European Pat. Off. . | |
| 2081833 | 12/1971 | France . | |
| 856958 | 12/1960 | United Kingdom . | |
| 2066766 | 7/1981 | United Kingdom . | |
| 2250972 | 6/1992 | United Kingdom | 220/671 |
| 2266290 | 10/1993 | United Kingdom | 220/669 |

*Primary Examiner*—Sue A. Weaver
*Attorney, Agent, or Firm*—Scully, Scott, Murphy & Presser

[57] ABSTRACT

The present invention relates to a blow molded plastic container whose thin wall shoulder portion has a plurality of rib-like protrusions. Each of said rib-like protrusions are configured with multiple radii of curvature having a specifically defined relationship. The protrusions so formed do not adversely affect the integrity of the shoulder portion wall structure and do not distort upon internal pressurization of the container.

20 Claims, 7 Drawing Sheets

RIB FOR PLASTIC CONTAINER

BACKGROUND OF THE INVENTION

1. Field of the Invention

The present invention pertains to plastic containers for beverages, particularly carbonated soft drink products and the like. More specifically, the invention relates to a blow molded plastic container whose shoulder portion comprises as an integral part thereof, a plurality of rib-like protrusions. These rib-like protrusions, which are outwardly-extending, are configured using multiple radii of curvature such that they may be successfully incorporated into even thin wall shoulder portions of the type found in commonplace non-returnable containers, and will furthermore remain intact even when such containers are under internal pressurization. The protrusions subject of the instant invention have the practical effect of lending improved grip and manual handling characteristics to the container, as well as providing mechanical reinforcement to the shoulder portion.

2. Description of the Prior Art

The use of plastic containers to package beverages, especially carbonated soft drink products, has been remarkably successful since such containers were first introduced in the 1970s. The widescale application of these containers stems primarily from the fact that the plastic material from which they are made, which materials are invariably thermoplastics, most especially polyesters such as polyethylene terephthalate (PET), can be biaxially oriented. Biaxial orientation involves aligning the polymer chains in two directions, the consequence being closer, more orderly packing of material. The practical benefits of this phenomenon are two fold: first, containers thus oriented can be produced with thin walls, often as a direct result of the orienting process itself; secondly, the mechanical strength and gas barrier properties of these thin-wall containers increases dramatically upon biaxial orientation. The overall result is a container that is light weight, yet extremely robust.

While it is known to fabricate biaxially oriented containers in any number of ways, the most commercially important are those which employ stretch blow molding techniques. These techniques generally utilize a preform or parison, typically produced by way of injection molding, which is heated, or cooled as the case may be, to at or near the glass transition temperature of the material. When at this temperature, the preform is placed into a blow mold wherein it is stretched longitudinally by a stretch rod and expanded horizontally by air or other operating gas pressure. The product is a container whose body and shoulder portions have relatively thin walls and are biaxially oriented.

Although the thin wall construction of biaxially-oriented containers is advantageous overall, there are, nevertheless, certain drawbacks to the same. For example, the thin nature of the wall manifests little, if any, tolerance for a topographical configuration that is other than smooth, uniform and continuous. Thus even though it may be desirable to provide alterations or embellishments to the wall, it has been difficult, if not impossible, to do so without adversely affecting the mechanical integrity of the same, especially where the container is under conditions of stress, such as caused by the internal pressurization associated with the packaging of carbonated soft drinks.

Of the efforts made in this regard are those directed to placing inwardly directed ridges or ribs in the shoulder portion of such containers in order to improve grip and the consumer's ability to hold and handle the container. Despite the benefits such a feature would offer, it has not been possible to implement the same in a practical manner, much less a commercially acceptable one, in thin wall non-returnable containers. The attempts made in this regard have generally relied upon an inward rib configuration having but one radius of curvature, which type of configuration has typically resulted in a container having areas of unusually high stress at juncture points between the rib or ridge and the shoulder portion, which circumstance, under conditions of internal pressurization, can lead to container failure. More commonly, however, these attempts have resulted in ribs or ridges that evert, distort or deform, either in whole or in part, under conditions of internal pressurization.

The art thus recognizes a continuing need to develop a convenient and practical design for a rib-like protrusion which will not detract from the mechanical integrity of the container and will remain physically and visually intact upon pressurization.

SUMMARY OF THE INVENTION

The present invention overcomes the problems heretofore associated with attempts to provide ribs or ridges on the shoulder portion of thin wall, non-returnable plastic containers. In accordance with the invention, rib-like protrusions are provided in the shoulder portion using multiple radii of curvature having a specifically defined relationship. The rib-like protrusions, when implemented pursuant to the invention, do not adversely affect the mechanical strength or integrity of the shoulder wall, nor do they evert, distort or otherwise deform under conditions of use, including internal pressurization.

In accordance with the invention, there is provided a blow molded plastic container having a neck portion adapted to receive a closure; a shoulder portion; a body portion; and a bottom portion; the shoulder portion has along at least part of the length thereof, a plurality of upwardly directed rib-like protrusions wherein each protrusion, in axial cross-section, has a first transition portion, a central portion and a second transition portion, all of which are connected in series. The first transition portion is concave outwardly and has a substantially uniform radius of curvature, $R_1$; the central portion is concave inwardly and has a substantially uniform radius of curvature, $R_2$; and the second transition portion is concave outwardly and has a substantially uniform radius of curvature $R_3$.

In the practice of the present invention, $R_1$ and $R_3$ are substantially the same and are greater than $R_2$. In a preferred mode, $R_1$, and $R_3$ are substantially the same and are about 7 to 9 times greater than $R_2$; more preferably $R_1$, and $R_3$ are about 7.5 to 8.5 times greater than $R_2$; still more preferably they are about 8.0 times greater than $R_2$.

In one embodiment of the present invention, $R_1$ and $R_3$ are each independently about 6.30 mm to about 6.40 mm, and $R_2$ is about 0.74 mm to about 0.84 mm. In a preferred aspect of this embodiment, $R_2$ and $R_3$ are each independently about 6.35 mm and $R_2$ is about 0.79 mm.

Geometrically, while the upwardly directed rib-like protrusions may be straight and oriented either vertically or at an angle, other patterns may be employed. Thus in one embodiment of the invention the rib-like protrusion are oriented in the form of an upwardly directed spiral or like configuration. In a preferred aspect of this embodiment, the spiral is configured such that the rib-like protrusions diverge from one another as they proceed down the length of the shoulder portion toward the body portion.

While the number of rib-like protrusions may vary, it is preferred that they be spaced apart from one another. As will be appreciated by those of skill in the art in this regard, it is preferred if the rib-like protrusions are equidistant, one from the other; the spacing apart between adjoining protrusions in this situation is conveniently measured by angle α, which bisects the central portion of adjoining protrusions and has, as its point of origin, the longitudinal axis of the container. In a particularly preferred embodiment, angle α is approximately 25.7°, resulting in fourteen rib-like protrusions being circumferentially disposed equidistant about the shoulder portion of the container.

While for purposes of the invention, the rib-like protrusions need extend along only a part of the length of the shoulder portion, it is preferable if they extend along substantially the entire length of said shoulder portion. While the length of said shoulder portion can vary depending upon the size and other conformational characteristics of the container, it is generally equal to about 30% of the total height of the container.

In the circumstance where the rib-like protrusions are spaced apart one from the other, and in the particular embodiment wherein they extend along substantially the entire length of the shoulder portion, it is preferred that the outer surface of said shoulder portion between each of said spaced apart protrusions be substantially flat.

In one embodiment of the present invention, the rib-like protrusions are spaced apart equidistant from one another and extend along substantially the entire length of the shoulder portion to terminate at or near that part of the shoulder portion proximate the neck portion and that part of the shoulder portion proximate the body portion. In this circumstance, the outer surface of the shoulder portion between the protrusions, as extant along the entire length of the same, is either substantially flat or outwardly arcuate in the circumferential direction.

In another aspect of this embodiment, the outer surface of the shoulder portion proximate the body portion tapers radially outwardly toward said body portion to form terminal segments. In a preferred practice, the length of these terminal segments extends up to about 20%, more preferably about 10 to about 15%, of the length of the shoulder portion as measured from above said body portion. While these terminal segments may take any number of configurations, it is preferred that they be of parabolic shape, the curve or dome of the parabola being oriented toward the neck portion of the container.

In practice, the present invention can be successfully implemented in containers having thin wall shoulder portions. In general, the wall thickness of shoulder portions contemplated in this regard are from about 0.22 mm to about 0.35 mm, more typically from about 0.25 mm to about 0.28 mm. As will be appreciated by those of skill in the art, this magnitude of wall thickness is commonly employed in non-returnable beverage containers, also known as one-way or disposable containers. The present invention need not be limited to such containers however.

Containers of the present invention can further be fabricated by techniques well known in the art. Of the more preferable methods in this regard is stretch blow molding, employing a preform or parison of conventional design and a blow mold wherein that aspect of the mold corresponding to the shoulder portion of the container of the invention is configured consistent with the description provided herein to produce the rib-like protrusions subject of the present invention. As will be appreciated by those of skill in the art the rib-like protrusion of the present invention may be implemented in containers of any size, including without limitation sizes commonly found in commercial use such as from 0.33 liter to 2.0 liter and greater.

While any plastic material suitable for use with beverages, including soft drink products and the like, may be employed, it is preferred as a practical material that thermoplastics, more preferably polyesters, be employed. The most preferred polyester material in this regard is polyethylene terephthalate, or PET. PET as contemplated herein includes homopolymer PET and copolymer PET including, without limitation, those copolymers wherein the ethylene glycol component has been replaced, in part, with, e.g., cyclohexane dimethanol; and those wherein the terephthalic acid component is replaced, in part, with, e.g., isophthalic acid. As those of skill in the art will recognize, the intrinsic viscosity (IV) of the PET can vary depending upon considerations of use setting and container conformation, and is generally greater than about 0.55, usually greater than about 0.75, and most commonly about 0.80 to 1.00.

The foregoing features of the present invention are illustrated by the drawings and related detail discussion provided hereinbelow.

DETAILED DESCRIPTION

Figure 1:
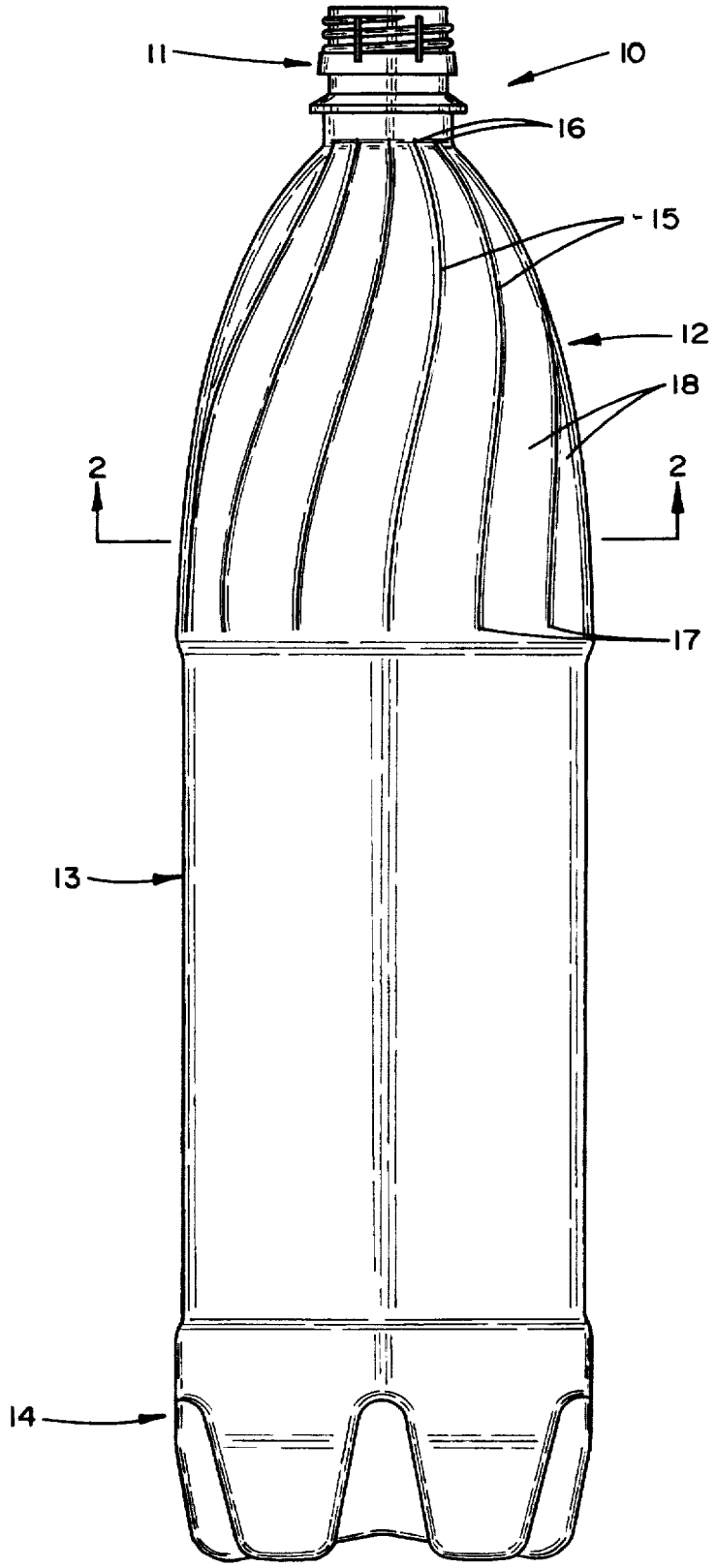
FIG. 1 is an elevational view of a container of approximately 1500 ml size having rib-like protrusions in the shoulder portion as contemplated by the present invention. The figure illustrates an embodiment of the invention wherein the rib-like protrusions are in the form of a spiral.

Referring now to the drawings in detail, there is shown at FIG. 1 an embodiment of the present invention. Depicted thereat is a blow molded plastic container 10, the container illustrated being of about 1500 ml size and having a neck portion 11 adapted to receive a closure, a shoulder portion 12, a body portion 13, which is generally tubular in shape, and a bottom portion 14 which may be of either the petaloid or champagne push-up type, petaloid being depicted. As will be appreciated by those of skill in the art, for purposes of the present invention the bottom portion may also be outwardly hemispherical, which normally requires the conjoint use of a base cup.

As shown in FIG. 1, the shoulder portion has a plurality of upwardly directed rib-like protrusions 15. As illustrated in FIG. 1, these rib-like protrusions extend along substantially the entire length of shoulder portion 12, and have termini 16 proximate neck portion 11 and termini 17 proximate body portion 13. In FIG. 1, the rib-like protrusions 15 are in the form of a spiral, the particular embodiment illustrated showing the spiral diverging as it proceeds from that part of the shoulder portion proximate neck portion 11 to that part proximate body portion 13.

Figure 2:
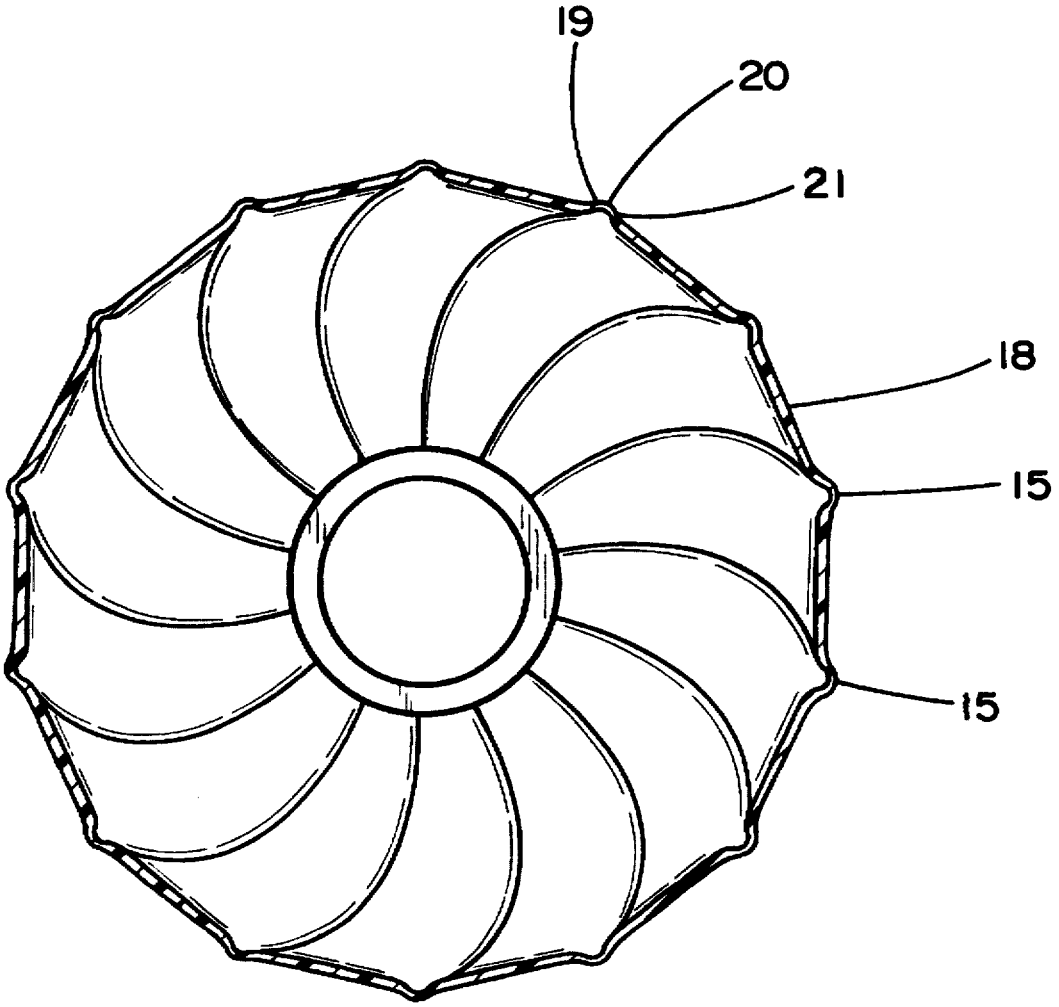
FIG. 2 is an horizontal cross-section of the container illustrated in FIG. 1 taken along section line 2—2.

Turning now to FIG. 2, there is shown the horizontal cross-section of container 10 taken along section line 2—2. As shown therein, shoulder portion 12 of container 10 embodied at FIG. 1 has fourteen rib-like protrusions 15. Each of said protrusions 15, as shown in the axial cross-section of FIG. 2, has a first transition portion 19, which is concave outwardly and is connected to a central portion 20, which is concave inwardly. Central portion 20 is in turn connected to a second transition portion 21 which is concave outwardly. The details of this configuration and the multiple radii employed in forming rib-like protrusion 15 are shown at FIG. 3.

Figure 3:
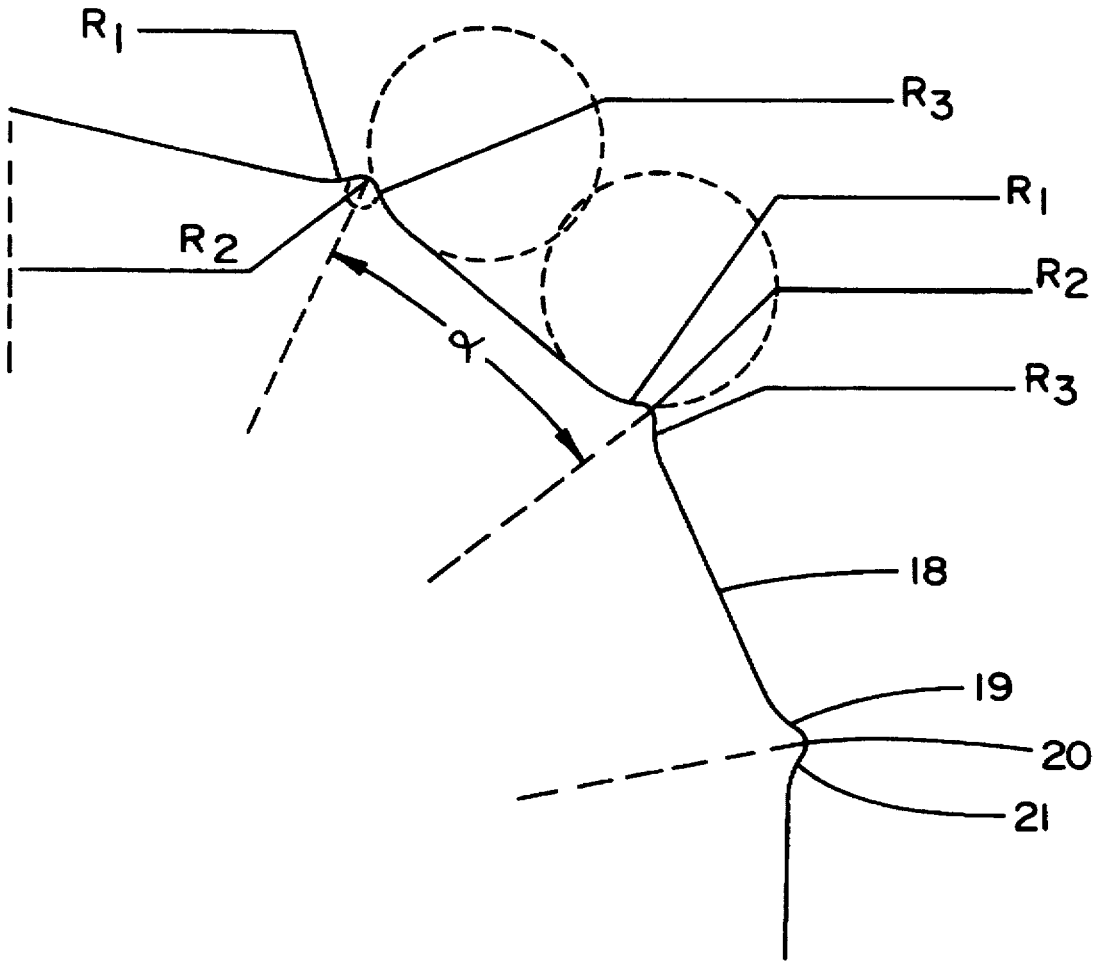
FIG. 3 is a partial enlargement of the cross-section shown in FIG. 2 illustrating details of the rib-like protrusions, including the radii of curvature employed to configure the same.

As illustrated in FIG. 3, first transition portion 19 has a substantially uniform radius of curvature $R_1$. As further seen in FIG. 3, the outwardly concave first transition portion inflects at central portion 20, this central portion being inwardly concave and having a substantially uniform radius of curvature $R_2$. To complete the configuration of protrusion 15, the central portion 20 inflects to form the second transition portion 21, which is concave outwardly and has a substantially uniform radius of curvature $R_3$. In the container depicted at FIG. 3, radii of curvature $R_1$ and $R_3$ are substantially the same and are approximately eight times greater than radius of curvature $R_2$.

In the embodiment depicted at FIGS. 1, 2 and 3, rib-like projections 15 are circumferentially disposed equidistant about shoulder portion 12. As shown in FIG. 3, protrusions 15 are spaced apart and separated from one another by angle $\alpha$, which bisects the central portions 20 of adjoining protrusions and has its point of origin at the longitudinal axis of container 10. Also depicted in FIGS. 1, 2 and 3 is a preferred embodiment of container 10 wherein the outer surface 18 of the shoulder portion 12 between each of protrusions 15 is substantially flat in the circumferential direction.

Figure 4:
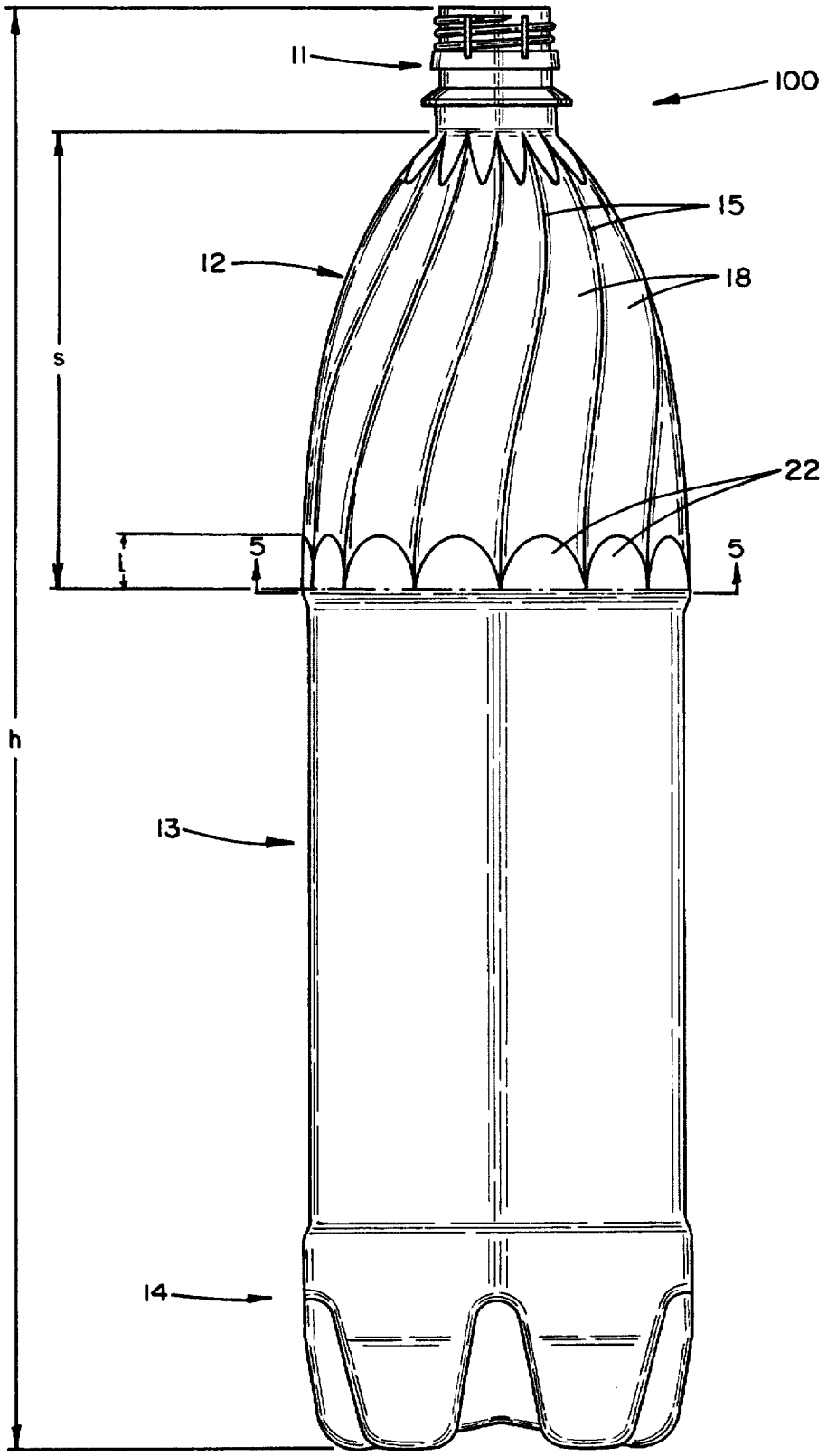
FIG. 4 is an elevational view of another embodiment of the present invention wherein the shoulder portion of a container of approximately 1500 ml size further comprises parabolic terminal segments.

Referring now to FIG. 4 there is shown another embodiment of the container of the present invention wherein rib-like protrusions 15 of shoulder portion 12 of a container 100 further comprises parabolic terminal segments 22. As illustrated, the length of these terminal segments, designated l, extends along the shoulder portion 12 above body portion 13. In practice, length l can be about 20% of the total length s of shoulder portion 12. In the illustration, l is approximately 12% of length s, which in turn is approximately 30% of height h of container 100.

Figure 5:
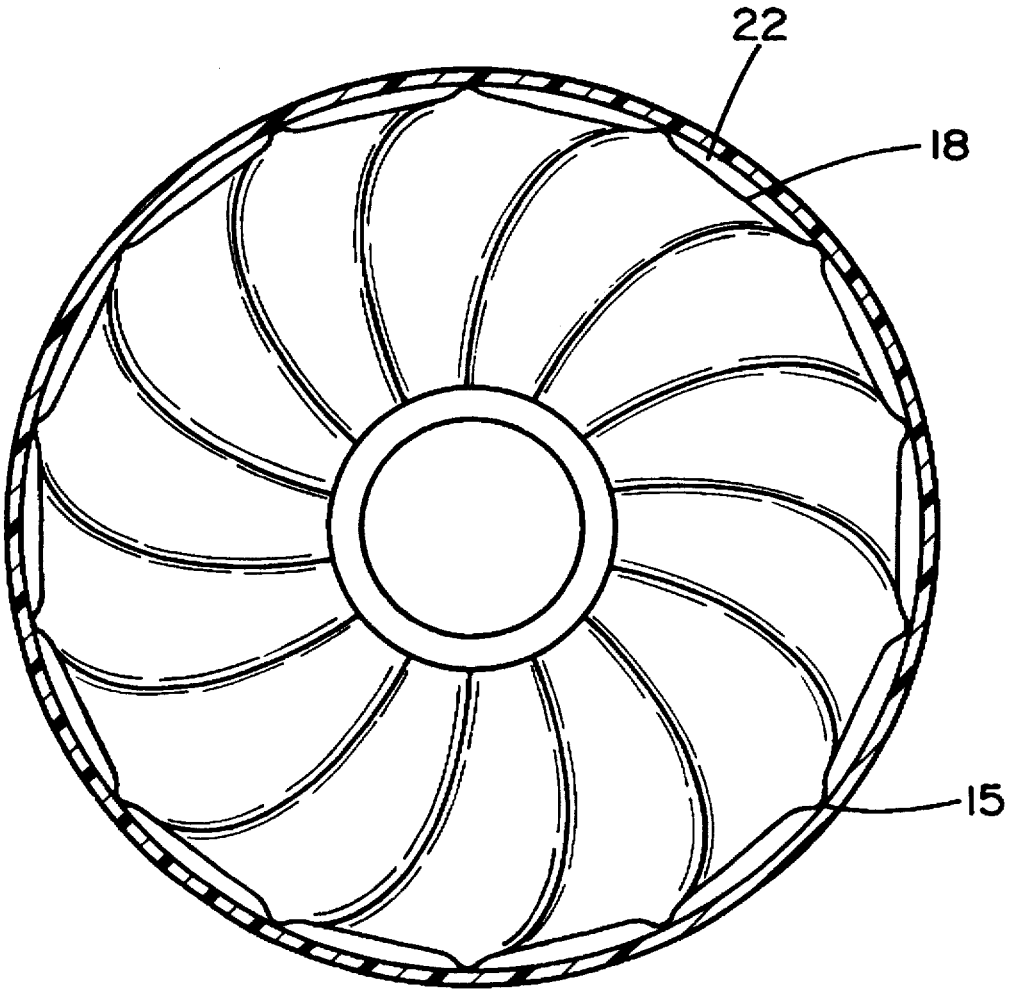
FIG. 5 is an horizontal cross-section of the container illustrated in FIG. 4 taken along section line 5—5.
Figure 6:
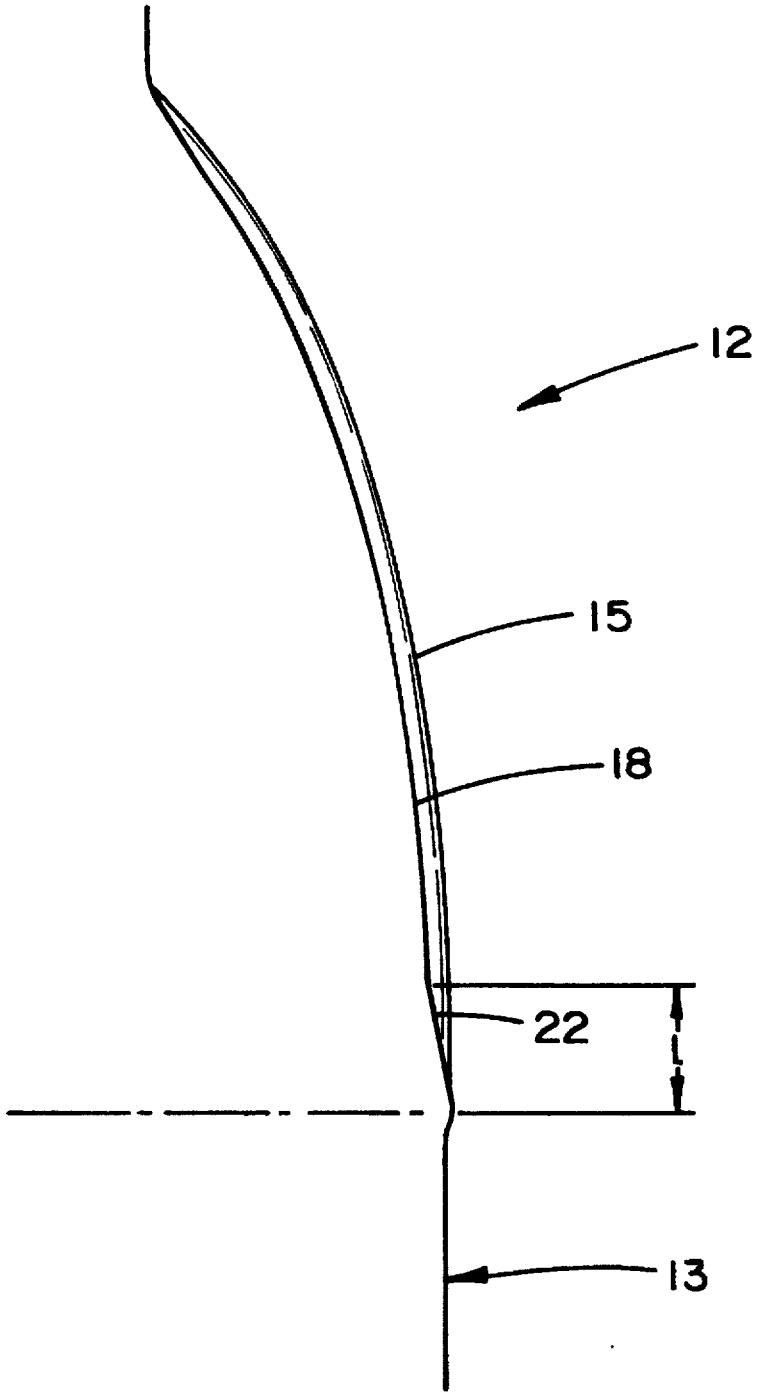
FIG. 6 is a partial enlargement showing the longitudinal cross-section of the wall of the shoulder portion of the container illustrated in FIG. 4 and the tapering details of the parabolic terminal segments.

In the container depicted at FIG. 4, the outer surface 18 of the shoulder portion 12 between rib-like protrusions 15 is flat in the circumferential direction, which can be seen by further reference to FIG. 5 which is an horizontal cross-section taken along section line 5—5 in FIG. 4. In the embodiment illustrated, terminal segments 22 taper outward toward body portion 13 along substantially the entire length l of said segments, as illustrated in detail at FIG. 6.

Figure 7:
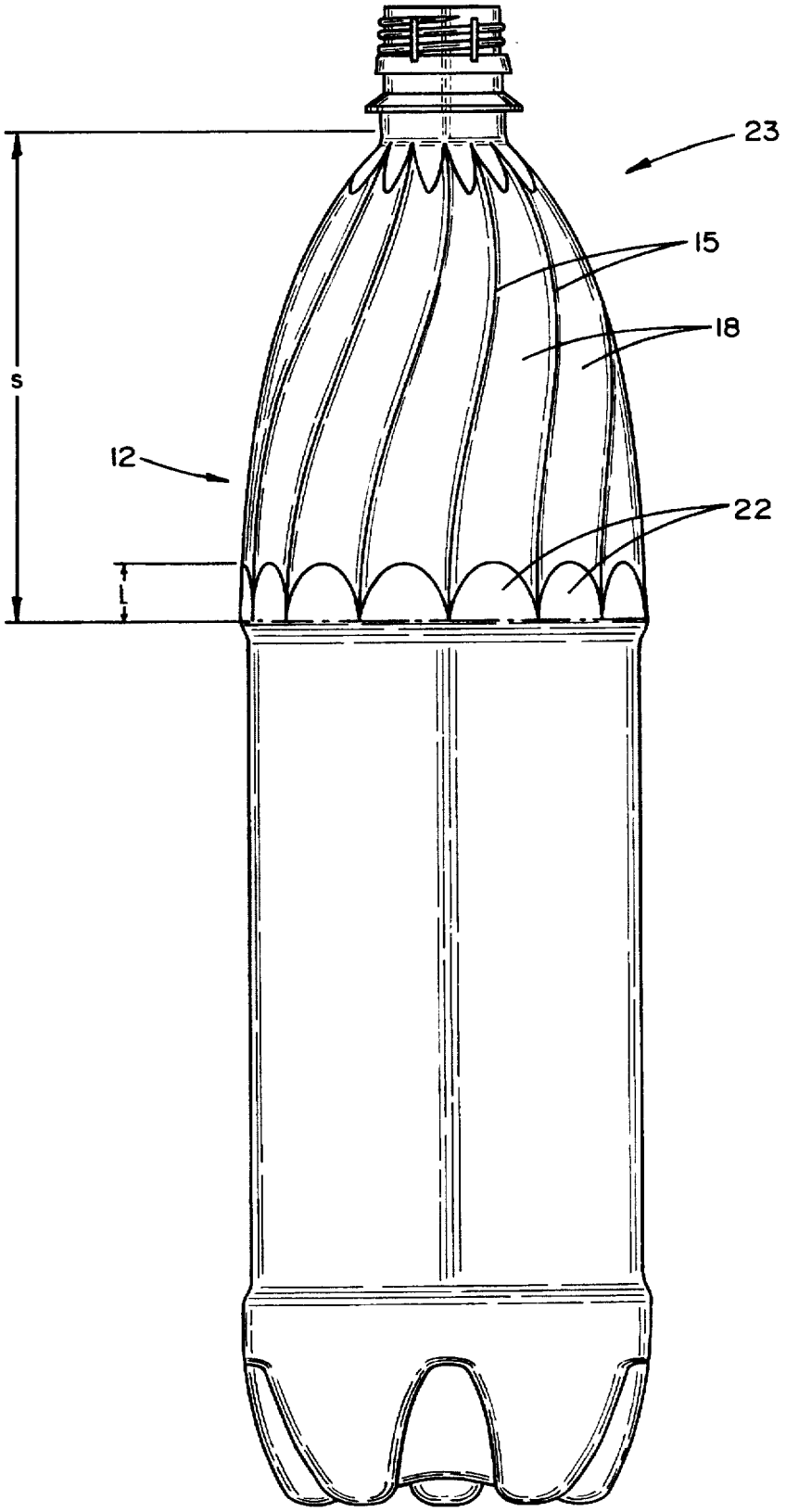
FIG. 7 is an elevational view of a container of approximately 2250 ml size having rib-like protrusions in the shoulder portion as contemplated by the present invention. The figure illustrates an embodiment of this size container wherein the rib-like protrusions are in the form of a spiral and the shoulder portion further comprises parabolic terminal segments.

The container illustrated at FIG. 7 depicts the rib-like protrusions 15 of the present invention oriented in divergent spiral form on the shoulder portion 12 of container 23 which is of about 2250 ml size. The shoulder portion, as shown, further comprises parabolic terminal segments 22 and circumferentially flat outer surface 18 between said protrusions 15. In the embodiment illustrated, the length l of terminal segments 22 is about 12% of the length, s, of shoulder portion 12. Length s, as depicted, is approximately 30% of the container height.

It is to be understood that the invention is not limited to the illustrations and other description provided herein, which are offered merely to exemplify the present invention.

What is claimed is:

1. A blow molded plastic container which comprises a neck portion adapted to receive a closure; a shoulder portion; a body portion; and a bottom portion, said shoulder portion having along at least a part of the length thereof a plurality of upwardly directed rib-like protrusions, each protrusion in horizontal cross-section having a first transition portion, a central portion and a second transition portion connected in series, said first transition portion being concave outwardly and having a substantially uniform radius of curvature $R_1$, said central portion being concave inwardly and having a substantially uniform radius of curvature $R_2$, and said second transition portion being concave outwardly and having a substantially uniform radius of curvature $R_3$ wherein $R_1$ and $R_3$ are substantially the same and are about 7 to 9 times greater than $R_2$.

2. The container of claim 1 wherein $R_1$ and $R_3$ are substantially the same and are about 7.5 to about 8.5 times greater than $R_2$.

3. The container of claim 2 wherein $R_1$ and $R_3$ are substantially the same and are about 8.0 times greater than $R_2$.

4. The container of claim 1 wherein $R_1$ and $R_3$ are each independently about 6.30 mm to about 6.40 mm and $R_2$ is about 0.74 to about 0.84 mm.

5. The container of claim 4 wherein $R_1$, and $R_3$ are each independently about 6.35 mm and $R_2$ is about 0.79 mm.

6. The container of claim 1 wherein said rib-like protrusions extend along substantially the entire length of said shoulder portion.

7. The container of claim 6 wherein said rib-like protrusions are spaced apart equidistant from one another, and the outer surface of the shoulder portion between each of spaced apart protrusions is substantially flat in the circumferential direction.

8. The container of claim 7 wherein said shoulder portion further comprises terminal segments disposed about the circumference thereof, said terminal segments being located between said rib-like protrusions and extending up to about 20% of the length of said shoulder portion above said body portion, said terminal segments being defined by a radially outward tapering of the outer wall surface of said shoulder portion, said outward tapering being in the direction of said body portion.

9. The container of claim 8 wherein said terminal segments are of substantially parabolic shape, the curve thereof being oriented toward said neck portion.

10. The container of claim 9 wherein said terminal segments extend up to about 10 to about 15% of the length of said shoulder portion above said body portion.

11. The container of claim 1 wherein said rib-like protrusions are oriented in the form of a spiral.

12. The container of claim 11 wherein the spiral is configured such that as said protrusions proceed down the length of said shoulder portion toward said body portion, the rib-like protrusions continuously diverge from one another.

13. The container of claim 1 wherein said shoulder portion has fourteen rib-like protrusions.

14. The container of claim 1 wherein said plastic is a thermoplastic.

15. The container of claim 14 wherein said thermoplastic is PET.

16. The container of claim 1 wherein said shoulder portion has a thickness of about 0.22 mm to about 0.35 mm.

17. The container of claim 16 wherein said shoulder portion has a thickness of about 0.25 mm to about 0.28 mm.

18. A stretch blow molded, PET container which comprises a neck portion adapted to receive a closure; a semi-rigid biaxially oriented shoulder portion having a wall thickness of about 0.22 mm to about 0.35 mm; a biaxially oriented tubular body portion; and a bottom portion, said shoulder portion having along substantially the entire length thereof, a plurality of upwardly directed rib-like protrusions oriented in the form of a spiral, said rib-like protrusions being disposed substantially equidistant from one another about the circumference of said shoulder portion, each of said rib-like protrusions in axial cross-section having a first transition portion, a central portion and a second transition portion connected in series, said first transition portion being concave outwardly and having a substantially uniform radius of curvature $R_1$, said central portion being concave inwardly and having a substantially uniform radius of curvature $R_2$, and said second transition portion being concave outwardly and having a substantially uniform radius of curvature $R_3$, wherein $R_1$ and $R_3$ are substantially the same and are about 6.30 mm to about 6.40 mm, and $R_2$ is about 0.74 mm to about 0.84 mm.

19. The container of claim 18 wherein said shoulder portion has fourteen of said rib-like protrusions and has a wall thickness of about 0.25 mm to about 0.28 mm.

20. The container of claim 19 wherein $R_1$ and $R_3$ are each independently about 6.35 mm, $R_2$ is about 0.79 mm and the outer surface of said shoulder portion between each of said rib-like protrusions is substantially flat in the circumferential direction.

* * * * *

UNITED STATES PATENT AND TRADEMARK OFFICE

CERTIFICATE OF CORRECTION

PATENT NO. : 5,593,056

DATED : January 14, 1997

INVENTOR(S) : Christopher J. Mero, et al.

It is certified that error appears in the above-identified patent and that said Letters Patent is hereby corrected as shown below:

Column 2, line 57: "$R_2$" should read --$R_1$--

Signed and Sealed this

Twenty-sixth Day of August, 1997

*Attest:*

Bruce Lehman

BRUCE LEHMAN

*Attesting Officer*

*Commissioner of Patents and Trademarks*